US005549150A

United States Patent [19]

Williams

[11] Patent Number: 5,549,150

[45] Date of Patent: Aug. 27, 1996

[54] GLASS PORCH ENCLOSURE

[76] Inventor: Fred G. Williams, 1695 Epping Farms La., Annapolis, Md. 21401

[21] Appl. No.: 356,734

[22] Filed: Dec. 15, 1994

[51] Int. Cl.[6] ..... E05D 15/16

[52] U.S. Cl. ..... 160/201; 160/202; 160/37

[58] Field of Search ..... 160/202, 201, 160/37, 222, 223

[56] References Cited

U.S. PATENT DOCUMENTS

| | | | |
|---|---|---|---|
| 2,750,914 | 6/1956 | MacGregor et al. | 160/202 X |
| 2,908,051 | 10/1959 | Sparkes | 160/202 X |
| 3,204,691 | 9/1965 | Rohrman | 160/202 |
| 3,313,338 | 4/1967 | Knight | 160/202 X |
| 3,430,676 | 4/1969 | Aberg | 160/202 |

*Primary Examiner*—Blair Johnson

*Attorney, Agent, or Firm*—John B. Dickman, III

[57] ABSTRACT

A porch enclosure system for enclosing a porch having a framework including a pair of side members with vertical parallel slots, a top member for housing a motor mechanism and storing a plurality of glass panels and a bottom member for receiving a reciprocating shuttle. The plurality of glass panels each having a weatherseal either on the top edge of the preferred embodiment or on the lower edge on a second embodiment and slot engaging side edges. The motor mechanism is connected to the reciprocating shuttle by cables to raise and lower the shuttle. The shuttle carries the glass panels up and down in the slots where each panel is stopped by a pair of removable stops in each slot in a relationship to create an enclosure. The bottom member and side member slots cooperate to remove all or individual glass panels. The bottom member has a removable panel and the slotted side members have unslotted areas where glass panels are quickly and easily removed by removing the stops.

15 Claims, 2 Drawing Sheets

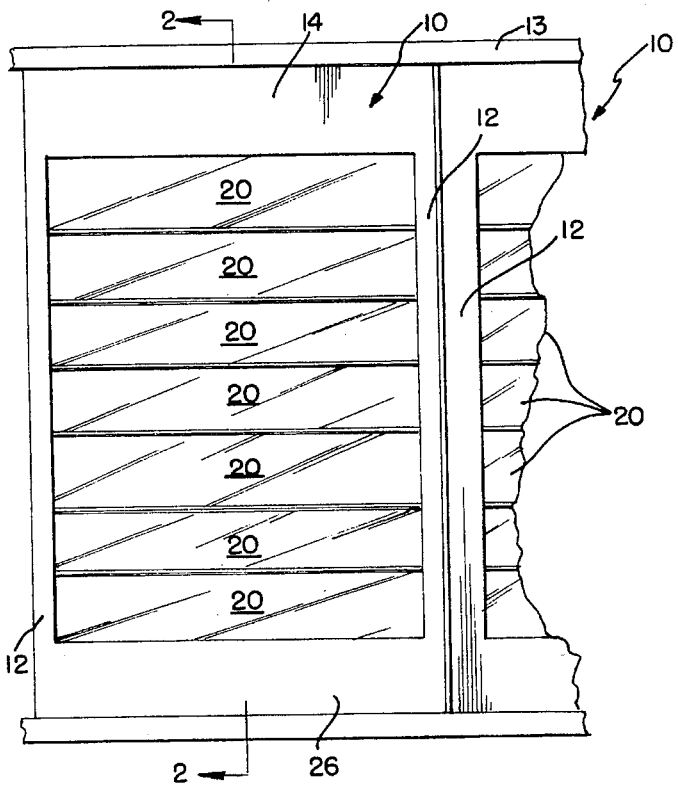
FIG. 1
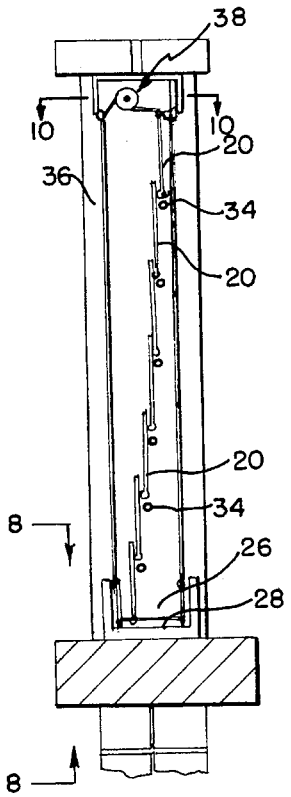
FIG. 2
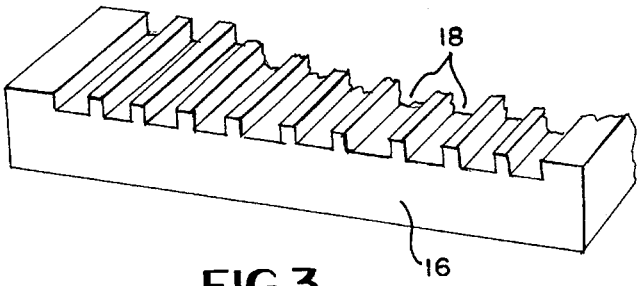
FIG. 3
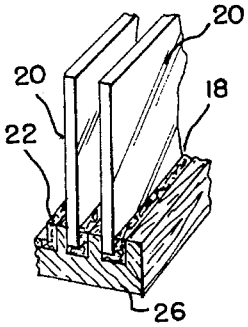
FIG. 4
FIG. 7
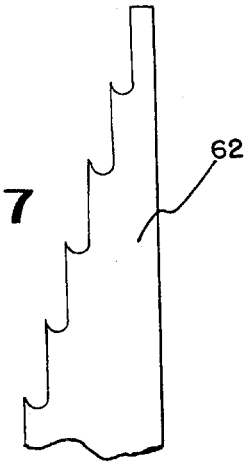
FIG. 8
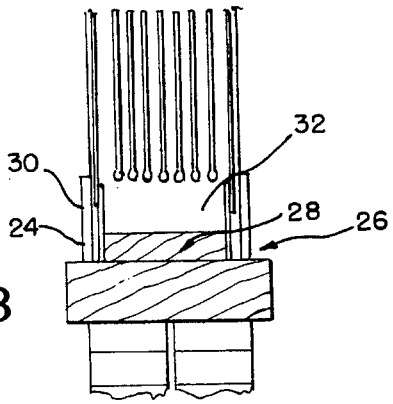

GLASS PORCH ENCLOSURE

BACKGROUND OF THE INVENTION

This invention relates to a glass enclosure for porches and the like, and more particular, to a glass enclosure in which a plurality of glass panels are reciprocated vertically to open and close the enclosure.

Various devices have been proposed heretofore as glass enclosures for porches and the like. In general, these devices have had some success, however, there have been defects which have not been addressed. For example, the often used jalousie windows which have a plurality of glass panels that pivot horizontally to open and close, require the mechanism for opening and closing the enclosure to have constant maintenance, otherwise the mechanism will bind. In other cases, the enclosure panels comprise two or more horizontally sliding glass panels and a track means where the glass panels, when fully open, still fill part of the enclosure opening blocking the enjoyment of the open air desired on screened porches. Furthermore, the track means is a regular catch basin for debris that inhibits the sliding of the glass panels.

The patent art is replete with porch enclosures having vertically moving glass panels, and also patent art on fire dampers and reciprocating doors which are of interest. U.S. Pat. Nos. 3,341,971 and 3,451,163 disclose fire dampers which use a plurality of vertically moveable panels which close in case of a fire. Each damper has a fusable link which releases when heated, allowing the panels to drop in a channel or the like. As each panel drops, it hooks the next panel until all of the panels are hooked together forming a fire shield. A somewhat similar arrangement is used in the door of U.S. Pat. No. 3,313,338, except that the panels which hook together are reciprocated vertically by a motor and pully system. In U.S. Pat. No. 3,698,465, the panels telescope vertically to open and close a door. As the panels are lowered each succeeding panel hooks onto the preceeding panel for support.

While the enclosures, fire dampers and doors are functional, they have drawbacks which limit their use as possible porch enclosures. The present invention overcomes the limitations of the prior art, as will be discussed.

SUMMARY OF THE PRESENT INVENTION

The present invention is directed to a porch or similar enclosure system, having vertically reciprocating glass panels that provide a secure and weatherproof enclosure. While the enclosure system is focused on porch enclosures, a similar system might be used in windows of other environments where it is desirable to have an opening which can be partially or fully opened.

The enclosure system is composed of a plurality of enclosure sections joined to a porch frame on the enclosure walls. Each enclosure section has it's own supporting frame for surrounding a plurality of reciprocating glass panels. The sides of the supporting frame are grooved or channelled to provide slots for individual glass panels to reciprocate therein. The bottom of the supporting frame is shaped to receive a reciprocating shuttle, and the top provides a storage area for the reciprocating glass panels.

Each panel is a flat sheet of glass, plastic or the like, which should be tempered for safety reasons, having an enlarged lower edge to abut and create a weather seal with the adjacent glass panel. The weather seal along the side edges of the glass panels assumes that the enlarged lower edges do not extend to the side edges to permit the panels to reciprocate in the side frame slots and to have close contact with weatherstripping in the slots.

The reciprocating shuttle spans the width of the enclosure section opening and is designed to move vertically to carry the glass panels in a reciprocating path in the slots. The enlarged lower edge, in the preferred embodiment of the invention, is a transparent strip of weatherstripping which presses against the top surface of an adjacent glass panel. In another embodiment, the enlarged lower edge is an enlarged cylindrical barrier integrally formed along the lower edge to press against an adjacent glass panel top surface. The shuttle is a bar with a cable connection to a motor mechanism for raising and lowering the glass panels. As stated in one position, when the glass panels are in a fully closed position, the reciprocating shuttle is stored in the bottom section of the frame. In the glass panel's fully open position, the shuttle is housed with the collected glass panels in the storage area of the top section of the frame. When the shuttle moves downwardly, all of the glass panels are, at first, resting on it and as the shuttle continues its downward travel, one by one the glass panels come to rest on stops located in each slot, said stops preventing further downward movement of said glass panels. By the time the shuttle has reached the bottom section of the frame, all of the glass panels are in place, forming a weather-tight and secure barrier.

The motor mechanism is housed in the top section of the frame above the area where the glass panels are stored. The motor mechanism is composed of an electric motor geared to a gear box with an output shaft. Mounted on the opposite ends of the shaft are take-up pulleys for paying out and winding in cable. There may be idler pulleys to control the movement of the cable. A cable made of stainless steel or some other weather resistant material extends from the take-up pulleys to the reciprocating shuttle to provide full movement of the shuttle in the enclosure frame.

BRIEF DESCRIPTION OF THE DRAWINGS

FIG. 1 is a front plan view of an enclosure system of the invention.

FIG. 2 is a side plan view taken along the line 2—2 of FIG. 1.

FIG. 3 is a partial perspective cross-section of a frame member of the invention.

FIG. 4 is a partial perspective of glass panels in slots of a frame member of the invention.

FIG. 7 is a side view of a slot cover of the invention.

FIG. 8 is a cross-section view taken along the line 8—8 of FIG. 2, with the glass panel supported on the shuttle.

DESCRIPTION OF THE INVENTION

Figure 9:
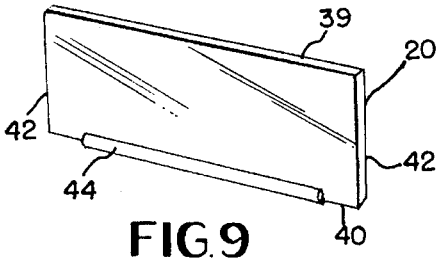
FIG. 9 is a partial perspective view of a glass panel of the invention.
Figure 10:
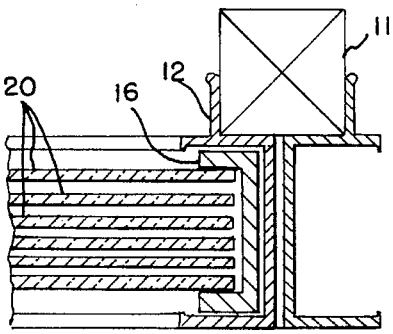
FIG. 10 is a cross-section view looking down, taken along the line 10—10 of FIG. 2, with the enclosure section open.
Figure 12:
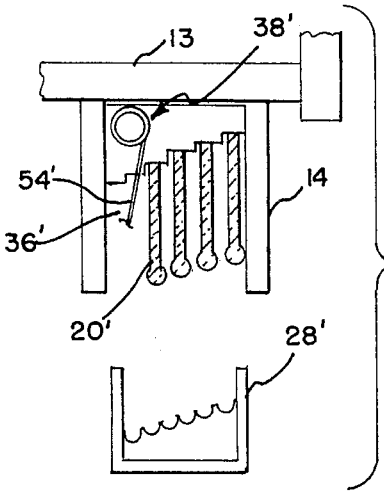
FIG. 12 is another enbodiment of the invention showing a stepped shuttle.
Figure 14:
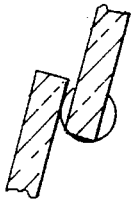
FIG. 14 is a cross-section view of adjacent glass panels of the invention showing a weather barrier along a bottom surface of one of the panels.

Referring to the drawings, FIGS. 1–12, there is shown a porch enclosure system of the invention. The porch enclosure system is designed to join a plurality of enclosure sections 10 together to enclose a porch frame. In FIGS. 1, 10 and 12, the enclosure sections and porch framing are shown. The enclosure sections partially shown in FIGS. 10 and 12 are extruded aluminum frames 12, FIGS. 10 and 14, FIG. 12, shown fastened to porch frame members 11 and 13, respectively. It is to be understood that any exposed fasteners are to be of the anti-vandal type to prohibit illegal entry.

The frame of the enclosure sections 10 has a pair of side members, shown in partial cross-section in FIG. 10 as member 12, and FIG. 3, with wood or metal insert 16. The insert 16 is grooved or channeled to provide slots 18 in which glass panels 20 slide, FIG. 4. The slots 18 are lined with a weatherstrip material 22 to protect against rain, snow and wind. The bottom member 24 has a U-shaped opening 26 which houses a reciprocating shuttle 28, FIGS. 6 and 2. Bottom member 24 has a removable inside face plate 30, FIG. 8 for cleaning and repairing the glass panels 20. To facilitate removing the glass panels 20, face plate 30 is removed and the glass panel 20 to be removed is manually slid in its slot in metal insert 16 to where the slots end, as shown in FIG. 8 as un-slotted area 32. It is important that the depth of an area 32 be equal to or greater than the width of the glass panels. There are glass panel stops 34, FIG. 2, for retaining each glass panel 20 at its particular location. When a glass panel 20 is to be removed, the stops 34 in that slot are first removed.

There is a U-shaped top member 14 which has an open area 36 for housing a motor mechanism 38 and the glass panels 20 for use when the enclosure is open.

Figure 11:
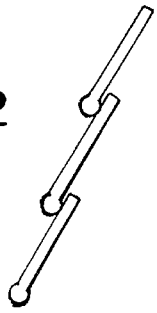
FIG. 11 is a side view of glass panels of the invention overlapping on another.
Figure 13:
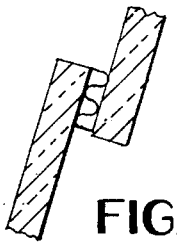
FIG. 13 is a cross-section view of adjacent glass panels of the invention showing a weather barrier along a top surface area of one of the panels.

Glass panel 20 is a flat sheet of tempered glass having a lower edge 40 and side edges 42. An enlarged area 44 is provided either along top edge 39 or lower edge 40, which stops short of side edges 42 to allow the panel to slide in slots 18 and maintain a good weather seal. The enlarged area 44, is best shown in FIGS. 9 and 11, function to create a barrier seal against weather conditions when the panels 20 are in a closed position. In the preferred embodiment the enlarged area 44 is a weatherstrip 60, FIG. 13 is designed to contact the surface area near the bottom of an adjacent glass panel, creating pressure on the surface, thereby forming a seal, as shown in FIGS. 11 and 2 (which is reversed).

Figure 5:
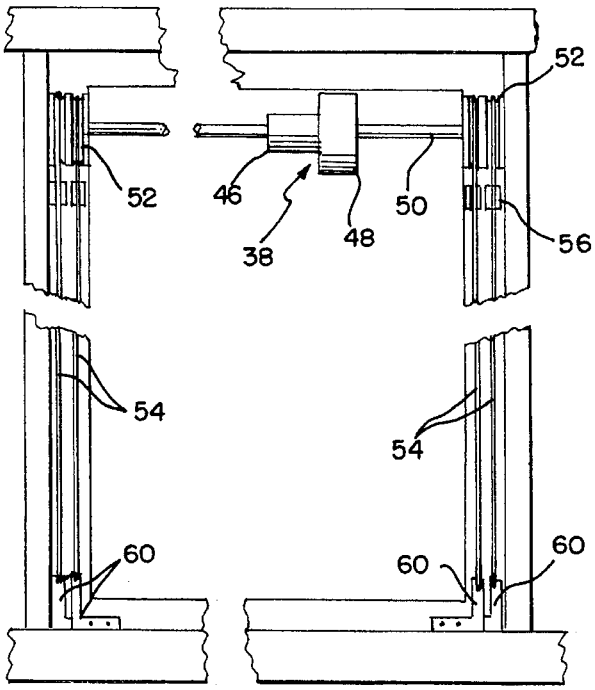
FIG. 5 is a front plan view of the motor mechanism and enclosure frame of the invention.
Figure 6:
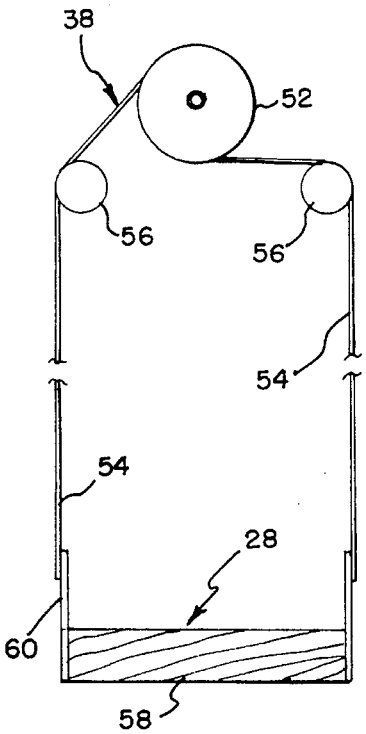
FIG. 6 is a side view of a pulley arrangement and reciprocating shuttle of the invention.

Weatherstrip 60 is transparent to reduce the effect of lines interferring with the visibility of the glass panels. FIGS. 5 and 6 show a motor mechanism 38 for reciprocating the glass panels 20 up and down. The mechanism 38 is comprised of an electric motor 46 geared to a gear box 48 which turns an output shaft 50. Mounted on the ends of the output shaft 50 are take-up pulleys 52. Connected to the take-up pulleys 52 are cables 54. The other ends of cables 54 are connected to the reciprocating shuttle 28, therefore when the cables 54 are payed out, the shuttle 28 is lowered and when the cables 54 are wound, the shuttle 28 is raised. FIG. 6 also shows idler pulleys 56 to guide the cables 56.

Reciprocating shuttle 28 has a wooden bar 58 which extends between the side frames 16. The bar 58 is of a length to freely slide between the frames without contacting the slots 18 of the insert 16. The ends of bar 58 has a pair of brackets 60 to which the cables 54 connect.

In use, the enclosure sections 10 are fastened to vertical frame members 11 and horizontal frame members 13. With the glass panels 20 in the open position, the panels are housed in the top member 14 as in FIGS. 12 and 10, the motor mechanism 38 is operated to lower shuttle 28 which carries glass panels 20. As the glass panels 20 travelling in slots 18 are lowered, they move together until each in turn comes in contact with a pair of stops 34. The first glass panel 20 to contact stops 34 is the first uppermost outside panel. The next adjacent panel and so on is in turn stopped in place until the enclosure is closed. In the closed position, the enlarged areas 44 seal the panels against any weather elements.

To raise or lower the glass panels 20, the reciprocating shuttle 28 controls the movement of each panel, so as to prevent any sudden impact on the panels.

FIG. 7 shows a slot cover plate 62 which is stepped to match the positions of the glass panels 20. After the enclosure section has been installed, the slot cover plate 62 is installed to provide a finished appearance and defeat possible attempts to remove panels.

When it becomes necessary to remove a particular glass panel 20 without removing other panels, the reciprocating shuttle 28 first raises all of the panels into top member 14 and then the stops 34 of the panel to be removed are removed. The shuttle 28 is lowered carrying the glass panel 20 which is to be removed to unslotted area 28 for removal.

FIGS. 9 and 11 show an enlarged area 44 which is provided along the lower edge 40. Enlarged area 44 in this embodiment is a cylindrical barrier 62, FIG. 14, which applies pressure to the top surface of an adjacent glass panel.

Other embodiments of the invention are shown in FIGS. 12, 5 and 6, where the reciprocating shuttle 28 is stepped to receive the glass panels 20 at sequential higher levels. There is also shown, a motor mechanism 38 which uses a single cable 54 on each end of an output shaft to raise and lower the glass panels.

A full enclosure screen, not shown, is mounted on the outside of the glass panels to further increase the enjoyment of an enclosed porch.

While only two embodiments of the invention have been disclosed, it should be understood that other embodiments may be realized, therefore one should study the drawings, description of the invention and the claims for a complete understanding.

I claim:

1. An enclosure system for porches, comprising;

A frame means adapted to be fastened to a porch frame including a pair of side members having insert means with parallel slots, a bottom member having an open area, and a top member having a storage and housing area:

a plurality of glass panels each having slot engaging ends for reciprocating in said parallel slots, each of said parallel slots having seal means to seal said enclosure system against various weather conditions, said glass panels each having a lower edge with a cylindrical barrier means extending across said lower edge stopping short of said slot engaging ends, where said cylindrical barrier means engages an adjacent glass panel having a top surface to create a weather barrier between said glass panels, a motor mechanism and reciprocating shuttle means for raising and lowering said plurality of glass panels in said slots, said reciprocating shuttle means including an elongate bar means extending between said side members which carriers said plurality of glass panels vertically and a bracket means for connecting to said motor mechanism, said motor mechanism having means to raise and lower said reciprocating shuttle means connected to said reciprocating shuttle means, and means to remove said glass panels from said frame bottom member individually.

2. An enclosure system as in claim 1 wherein said motor mechanism and reciprocating shuttle includes an electric motor geared to a gear system for rotating an output shaft, said output shaft having take-up pulleys on each end, a cable means connecting said take-up pulleys to said reciprocating shuttle to raise and lower said reciprocating shuttle, whereby said reciprocating shuttle carries said plurality of glass panels in said slots.

3. An enclosure system as in claim 2 wherein said slots each having a pair of removable stops to retain individual glass panels at a position relative to adjacent glass panels to create a complete enclosure.

4. An enclosure system as in claim 3 wherein said insert means having parallel slots has an unslotted lower end for removal of said plurality of glass panels.

5. An inclosure system as in claim 4 wherein said bottom member having a removable panel to cooperate with said unslotted lower end of said insert means for removing said plurality of glass panels.

6. An enclosure system as in claim 5 wherein individual glass panels are removable.

7. An enclosure system as in claim 6 wherein said reciprocating shuttle being stepped to receive said plurality of glass panels.

8. An enclosure means as in claim 7 wherein said frame side members having an exterior surface, and a slot cover means to cover said slots on said exterior surface.

9. An enclosure system as in claim 1 wherein said glass panels having an upper edge surface with a transparent weatherstripping means extending along said upper edge surface stopping short of said slot engaging ends, where said weather stripping means engages an adjacent glass panel having a bottom surface area to create a weather barrier between said glass panels.

10. An enclosure system as in claim 9 wherein said motor mechanism and reciprocating shuttle includes an electric motor geared to a gear system for rotating an output shaft, said output shaft having take-up pulleys on each end, a cable means connecting said take-up pulleys to said reciprocating shuttle to raise and lower said reciprocating shuttle, whereby said reciprocating shuttle carries said plurality of glass panels in said slots.

11. An enclosure system as in claim 9 wherein said slots each having a pair of removable stops to retain individual glass panels at a position relative to adjacent glass panels to create a complete enclosure.

12. An enclosure system as in claim 9 wherein said insert means having parallel slots has an unslotted lower end for removal of said plurality of glass panels.

13. An enclosure system as in claim 9 wherein said bottom member having a removable panel to cooperate with said unslotted lower end of said insert means for removing said plurality of glass panels.

14. An enclosure system as in claim 9 wherein individual glass panels are removable.

15. An enclosure system as in claim 9 wherein said reciprocating shuttle being stepped to receive said plurality of glass panels.

* * * * *